United States Patent [19]

Deutsch

[11] Patent Number: 4,702,142

[45] Date of Patent: Oct. 27, 1987

[54] FUNDAMENTAL FREQUENCY VARIATION FOR A MUSICAL TONE GENERATOR USING STORED WAVEFORMS

[75] Inventor: Ralph Deutsch, Sherman Oaks, Calif.

[73] Assignee: Kawai Musical Instruments Mfg. Co, Ltd, Hamamatsu, Japan

[21] Appl. No.: 853,112

[22] Filed: Apr. 17, 1986

[51] Int. Cl.[4] ..... G10H 1/06; G10H 7/00

[52] U.S. Cl. ..... 84/1.01; 84/1.19; 84/1.28

[58] Field of Search ..... 84/1.01, 1.03, 1.19–1.28

[56] References Cited

U.S. PATENT DOCUMENTS

| | | | |
|---|---|---|---|
| 3,763,364 | 10/1973 | Deutsch et al. | 84/1.03 X |
| 3,908,504 | 9/1975 | Deutsch | 84/1.27 X |
| 3,978,755 | 9/1976 | Woron | 84/1.24 |
| 4,273,018 | 6/1981 | Deutsch | 84/1.27 X |
| 4,442,745 | 4/1984 | Gross et al. | 84/1.01 |
| 4,579,032 | 4/1986 | Deutsch | 84/1.01 X |
| 4,638,710 | 1/1987 | Kitamura et al. | 84/1.26 |

*Primary Examiner*—S. J. Witkowski

*Attorney, Agent, or Firm*—Ralph Deutsch

[57] ABSTRACT

A keyboard operated musical instrument is disclosed in which musical tones are created by reading out data values stored in a waveshape memory. The number of stored data points is reduced by storing the data values in segments corresponding to one-half of the number of data points for a period of a waveshape. By using synthesized data having a symmetry about the midpoint, the second half of the waveshape is recovered by a forward and backward memory address read of each waveshape segment. After reading each segment a predetermined number of cycles, an abrupt jump is made to the next segment of waveshape data points. The fundamental frequency of the tone is varied in a temporal manner by changing the memory advance rate of reading waveshape data out of memory in response to a frequency offset data corresponding to each segment of the waveshape data. An alternative embodiment is disclosed for a tone generator in which the musical waveshape is computed in real time from stored sets of harmonic coefficients.

15 Claims, 5 Drawing Figures

FUNDAMENTAL FREQUENCY VARIATION FOR A MUSICAL TONE GENERATOR USING STORED WAVEFORMS

BACKGROUND OF THE INVENTION

1. Field of the Invention

This invention relates to musical tone synthesis and in particular is concerned with an improvement for producing tones from stored musical waveshapes.

2. Description of the Prior Art

A wide variety of musical tone generation systems have been designed which attempt to realistically replicate the sounds produced by conventional acoustic musical instruments. In general many of these systems have produced only poor imitative sounds because they lack the capability to produce the complex temporal variations of the musical waveform that characterize a tone from a particular acoustic musical instrument.

The most obvious method to imitate an acoustic musical instrument is to record the sound and to replay these recordings in response to an actuated keyswitch. While at first thought the straightforward technique of recording and playback seems to be attractive, a practical realization of such a musical instrument can be burdened by a large amount of memory required to store the recorded data. The maximum amount of storage is associated with a system that uses a separate and distinct recording for each note played in the range of the musical instrument's keyboard. Some economy in the storage requirement has been made by using a single recording for several contiguous musical notes. This economy is based upon the tacit assumption that the waveshape for the imitated musical instrument does not change greatly between several successive notes.

Musical tone generators that store recorded musical waveshapes in a digital data format have been given the generic name of PCM (Pulse Coded Modulation). This is an unfortunate choice of a generic name because PCM in no way simply identifies the tone generator as one in which a recorded tone is sampled and simply stored in a binary data format. A musical instrument of the PCM type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

Data reduction schemes, in common with many other systems attempting to produce an implementation economy, must pay certain penalties. In the case of a PCM musical tone generator, the data compression, or data reduction schemes, eliminate or obscure temporal variation in the musical tones' frequency. Such variations are an essential ingredient which help impart a characteristic element to an acoustic musical instrument's sound and aids in making the tone have a non-mechanical like tone.

SUMMARY OF THE INVENTION

In a musical tone generator of the type in which the musical tone is generated by reading out stored waveshape data points a reduction in the number of stored waveshape data points is obtained without eliminating temporal variation of the tonal spectrum and the variation in the fundamental frequency. Each waveshape memory stores a number of segments of data points. Each segment corresponds to one-half of the period of a synthesized waveshape having a waveshape symmetry about a half-wave point and having a spectra equal to that of a corresponding segment of a musical tone recorded from a musical instrument.

The missing waveshape points are reconstructed by reading out each segment in a forward and reverse memory order and then jumping to an adjacent segment where the forward and back read operation is repeated.

A further reduction in the amount of stored data is obtained by repeating the data read for a given segment of waveshape memory a predetermined number of cycles before a jump is made to an adjacent segment.

The generated musical tone's frequency is controlled by a frequency number which is generated for each actuated keyboard switch. The temporal frequency variation is obtained by scaling the frequency number by selected scaling coefficients which are read out of a memory for each corresponding segment of the stored waveshape data.

An alternate system configuration is disclosed for a tone generation system in which the sequence of waveshape data points is computed in real time.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a musical tone generator of the type in which a musical waveshape is stored in a memory. The generated tones are created in response to actuation of the instrument's keyswitches by reading out the stored waveshape data repetitively at a rate which varies in a predetermined manner.

A musical tone generator of the type in which segments of waveshape data points are read in a forward and reverse memory order and then having the read position jump to an adjacent segment of waveshape data points is described in the copending patent application Ser. No. 06/827,983 filed Jan. 6, 1986, entitled "Data Reduction For A Musical Instrument Using Stored Waveform." The referenced invention and the present invention have the same inventor and both are assigned to the same assignee.

Figure 5:
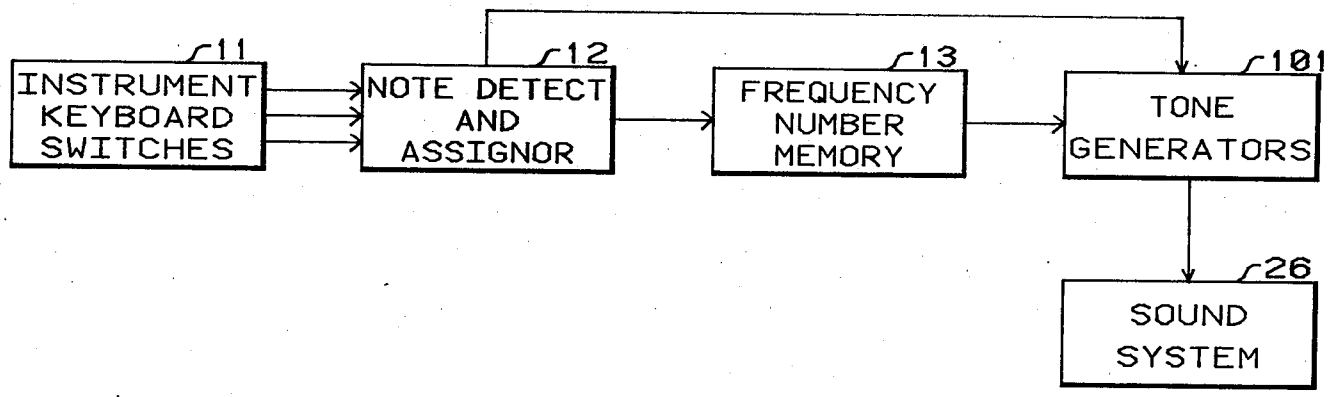
FIG. 5 is a schematic diagram of an embodiment of the invention.

FIG. 5 shows an embodiment of the present invention as incorporated into a keyboard operated electronic musical tone generator. The keyboard switches are contained in the system block labeled instrument keyboard switches 11. If one or more of the keyboard switches has a switch status change and is actuated ("on" switch position), the note detect and assignor 12 encodes the detected keyboard switch having the status change to an actuated state and stores the corresponding note information in a memory which is contained in the note detect and assignor 12. A tone generator is assigned to each actuated keyswitch using the encoded detection information generated by and stored in the note detect and assignor 12.

A suitable configuration for a note detect and assignor subsystem is described in U.S. Pat. No. 4,022,098 entitled "Keyboard Switch Detect And Assignor." This patent is hereby incorporated by reference.

When the note detect and assignor 12 finds that a keyboard switch has a switch status change to an actuated switch state, a frequency number corresponding to the actuated keyswitch is read from the frequency number memory 13 in response to the encoded detection information stored in the note detect and assignor 12. The frequency number memory 13 can be implemented as a read-only addressable memory (ROM) containing data words stored in binary numeric format having values $2^{(N-M)/12}$ where N has the range of values N=1,2, . . . , M and M is equal to the number of keyswitches on the musical instrument's keyboard. N designates the number of a keyswitch. These switches are numbered consecutively from "1" at the lowest keyboard switch. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

Figure 1:
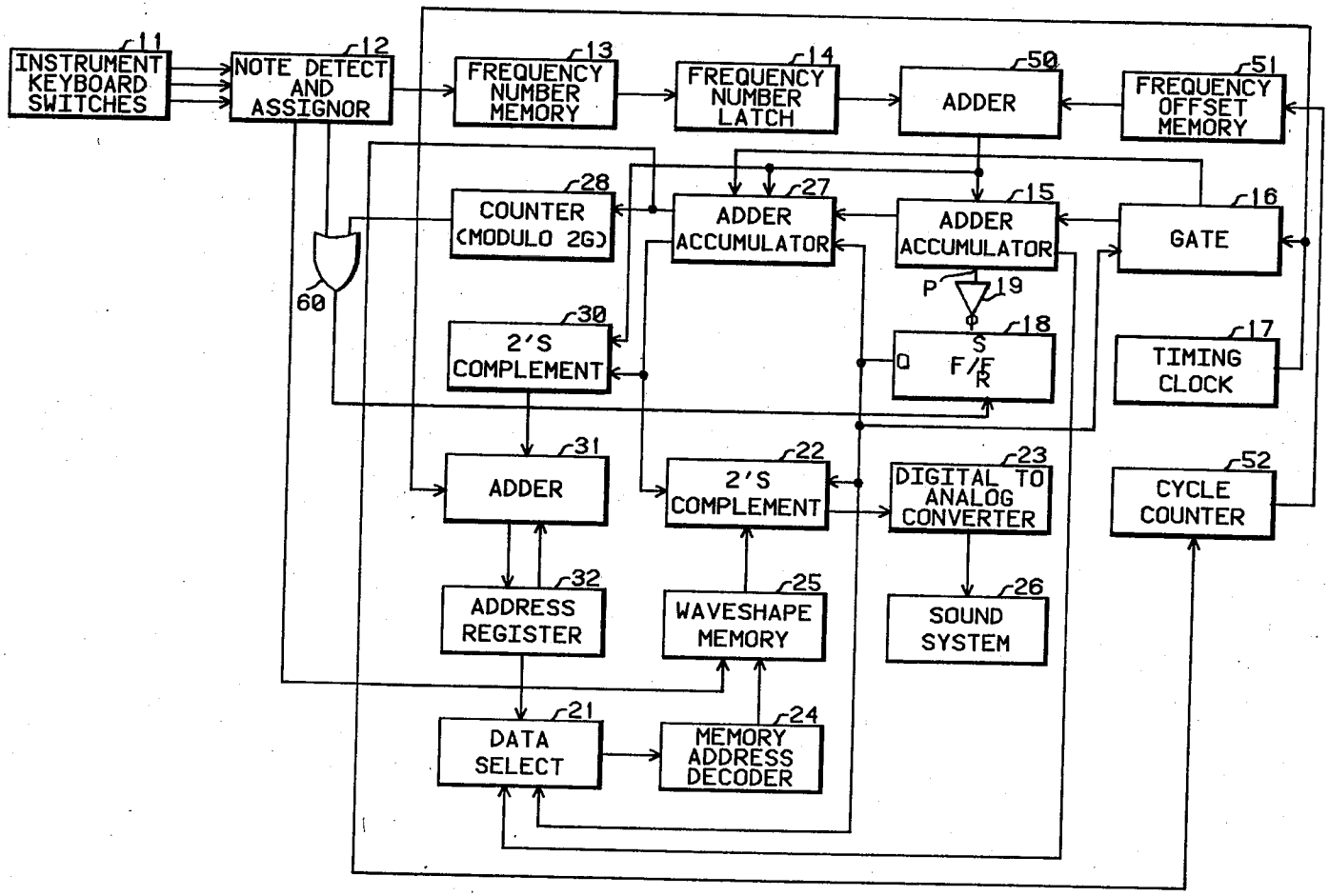
FIG. 1 is a schematic diagram of an embodiment of the invention showing the details of one of the tone generators.

FIG. 1 illustrates an embodiment of the invention showing details of one of the tone generators contained in the box of FIG. 5 labelled tone generators 101.

The frequency number read out of the frequency number memory 13 is stored in the frequency number latch 14.

In response to the count state of the cycle counter 52, a frequency offset number is read out from the frequency offset memory 51. The accessed frequency offset number is added to the frequency number stored in the frequency number latch 14 by means of the adder 50.

In response to timing signals produced by the timing clock 17 and transmitted by the gate 16, the modified frequency number produced by the adder 50 is successively added to the content of an accumulator contained in the adder-accumulator 15. The content of this accumulator is the accumulated sum of a frequency number.

Only a representative one of a plurality of tone generators, contained in the system block labelled tone generators 101 in FIG. 5, is shown in FIG. 1. The representative tone generator is comprised of the system blocks 14 50,51 26,27,15,16,60,19,30,18,17,31,22,23,52,32,25,21, and 24. These blocks can be replicated for the other tone generators to provide for a polyphonic tone generator.

When a tone generator, such as the one shown explicitly in FIG. 1, is assigned to an actuated keyswitch, the note detect and assignor 12 sends a signal via OR-gate 60 which resets the flip-flop 18 so that its output binary logic state is Q="0". In response to the state Q="0", the data select 21 selects the content of the accumulated frequency number contained in the adder-accumulator 15 to be transmitted to the memory address decoder 24. The data selected by the data select 21 is used by the memory address decoder 24 to read out waveshape data points stored in the waveshape memory 25.

In the manner described below, the waveshape memory 25 contains segments of half-period waveshapes which have been computed to have an odd symmetry about the midpoint of a period. If the state of flip-flop 18 is Q="0", then the 2's complement 22 will transfer the data read out of the waveshape memory 25 unaltered to the digital-to-analog converter 23. If Q="1", then the 2's complement 22 will perform a 2's complement numerical operation on its input data before it is sent to the digital-to-analog converter 23.

The waveshape memory 25 contains sets of these segments of half-period waveshapes. Each set corresponds to a different musical note, or to a corresponding keyboard switch. In response to the detect data generated by the note detect and assignor 12, a corresponding set of segments is selected by the signal set to the waveshape memory 25.

The data output from the 2's complement 22 is converted into an analog signal by means of the digital-to-analog converter 23. The resultant signal is transformed into an audible musical tone by means of the sound system 26 which consists of a conventional amplifier and speaker combination.

For the preferred embodiment of the invention, the number of data points in a segment of a half-period waveshape stored in the waveshape memory 25 is B/2 data points. B/2 is selected to be equal to a power of 2. A good choice for most musical tone generation systems is B/2=32 which corresponds to a waveshape having a maximum of 32 harmonics.

The selection of B/2 equal to a power of two is not a restriction or limitation of the invention. It is evident in view of the following description that any integer value of B/2 can be implemented.

The frequency number R stored in the frequency number latch 14 is in a binary digital numerical format which corresponds to a decimal number which is normally less than or equal to one. The accumulated frequency number contained in the accumulator of the adder-accumulator 15 can be considered to consist of an integer portion and a decimal portion. It is the integer portion of the accumulated frequency number that is transferred to the data select 21. For the decimal number equivalent of the accumulated frequency number, the radix point corresponds to the decimal point.

The output P from the adder-accumulator 15 is the value of the seventh bit to the left of the radix point of the accumulated frequency number. The generation of the P signal is called the first state detect means. In response to the binary logic state P="0", the inverter 19 causes the flip-flop 18 to be set so that its output binary logic state is Q="1". Q="1" is called the first state change signal.

While Q="1", the gate 16 inhibits the transfer of timing signals from the timing clock 17 to the adder-accumulator 15. Therefore during the state Q="1", the value of the accumulated frequency number in the adder-accumulator 15 is maintained constant at its current value.

In response to the change of state of the flip-flop from Q="0" to Q="1", the accumulated frequency contained in the adder-accumulator 15 is copied into the accumulator contained in the adder-accumulator 27.

For illustrative purposes it is assured that each waveshape segment stored in the waveshape memory 25 will be repeated G=4 times. This value of G is not a restriction nor a limitation of the invention. It is evident from the following description that any other value of G may be implemented.

In response to the state Q="1" of the flip-flop 15, the gate 16 transfers timing signals produced by the timing clock 17 to the adder-accumulator 27. The modified frequency number produced by the adder 50 is successively added to the accumulator contained in the adder accumulator 27 in response to the timing signals transferred by the gate 16 thereby generating an accumulated frequency number.

Each time that the first six bits to the left of the radix point of the accumulated frequency number in the adder-accumulator 27 all have a zero value, a second detect means generates a reset signal which increments the count state of the counter 28.

If the reset signal is generated by the adder-accumulator 27, then the 2's complement 30 will perform a 2's complement operation on the frequency number generated by the adder 50 before it is transferred to the adder 31. If this reset is not generated, then the 2's complement 30 does not perform a 2's complement operation.

In response to the timing signals furnished by the timing clock 17, the adder 31 successively adds the output value from the 2's complement 30 to the content of a register contained in the address register 32.

If the flip-flop 18 has the binary logic output state Q="1", the data select 21 selects the content of the address register 32 to be transferred to the memory address decoder 24. If the state is Q="0", the data select 21 selects the content of the adder-accumulator 15 to be transferred to the memory address decoder 24.

When the counter 28 is incremented to the count $2\times4=8$, a signal is generated which resets the flip-flop 18 so that its output state is now Q="0". At this time the current segment of waveshape has been read out 4 times from the waveshape memory 25.

The net result of the system logic described above is that each segment of B/2 waveshape data points stored in the waveshape memory 25 is read out in increasing memory order and then the same segment is read out is a reverse decreasing memory order and the missing waveshape data points are regained by using the synthesized waveshape data symmetry which is obtained by a procedure described below. Each waveshape segment is read out repetitively back and forth for G times and then a jump is made to the next segment of the waveshape memory 25.

The cycle counter 52 is incremented each time that the counter 28 is incremented by the adder-accumulator 27. The content of the cycle counter 52 is used to read out data stored in the frequency offset memory 51.

The data points stored in the waveshape memory 25 and the data values stored in the frequency offset memory can be obtained by the following procedural method. The procedure is illustrated for an acoustic musical instrument played for a note $A_4$ corresponding to a fundamental frequency of 440 Hz. A recording is made by passing the signal from the microphone through a low pass filter so that all frequencies above the 36th harmonic are strongly attenuated. The analog signal is converted to a digital sequence of data points by using an analog-to-digital converter operating at a sampling frequency of $f_s=32$ Khz. This sampling frequency is high enough to accommodate frequencies up to the 36th harmonic of the fundamental frequency.

The first analysis step is to determine the true steady state fundamental frequency. This is a necessary step to compensate for the inevitable inaccuracies in the analog-to-digital converters sampling clock frequency and the inaccurate tuning of the original acoustic musical instrument. A selected portion of the recorded data is made for the sustain, or constant, phase of the data obtained from the recording.

The next step is to determine the location of a zero crossing $A_0$, which has a selcted slope such as a positive slope. Since none of the selected portion of the recorded data will necessarily have an exact zero value, the zero crossing $A_0$ can be computed by interpolating between two successive data points that have opposite algebraic signs and such that the second point has a positive algebraic sign.

The estimated position $A_E$ for the end of a single period of the waveshape is found by using the estimated value of the fundamental frequency $f_0$ and the value of the sampling frequency $f_s$. This estimate for the endpoint is $$A_E=A_0+f_s/f_0 \qquad \text{Eq. 1}$$

A search is now made for a positive slope zero crossing which occurs in the neighborhood of the estimated value of $A_E$. If two such zero crossings are found which provide substantially the same estimates of the period of the waveshape, then the zero crossing having a positive slope closest to the initial point $A_0$ is selected.

The zero crossing at $A_E$ is now used as a starting point to estimate the period of the next segment of the selected subset of the recorded data. The two estimates of the period are then averaged to get an improved estimate of the period. This procedure is iterated until about five consecutive estimates have been computed for the period. These individual estimates are averaged to provide an average estimated period of $T_A$. It is noted that all distances are measured in the normalized measure of a number of data points.

The value of $T_A$ is now used to analyze consecutive segments of the recorded data starting at the beginning of the attack phase of the tone located at $A_{01}$. The positive slope zero crossing at $A_{E1}$ is found as described above using the estimated value $T_A$ for the true period. The period of the first period of the tone is then $$T_1=(A_{E1}-A_{01})/f_s \qquad \text{Eq. 2.}$$

The fundamental frequency $f_1$ for the first segment, or period, of the recorded data can be written as $$f_1=f_A+f_1 \qquad \text{Eq. 3}$$

where $f_A$ is the average estimated frequency $$f_A=1/T_A \qquad \text{Eq. 4.}$$

and $f_1$ is the frequency offset for the first segment. Therefore $$f_1=f_s/(A_{E1}-A_{01})-1/T_A \qquad \text{Eq. 5.}$$

The frequency number $R_1$ for the first segment can be written as $$R_1 = R_A + R_1 = F_1/F \quad \text{Eq. 6}$$

where $$R_A = f_A/F \quad \text{Eq. 7}$$

and F is the frequency of the timing clock 17.

Thus the first offset frequency number stored in the frequency offset memory 51 has the value $$R_1 = f_1/F - f_A/F \quad \text{Eq. 8.}$$

The data set points in the interval $A_{01}$ to $E_1$ are next interpolated to find a set of 64 equally spaced points for the same fundamental period. A Fourier analysis is computed using these 64 data points to determine a set of harmonic coefficients. An inverse Fourier analysis is then performed using these harmonic coefficients to compute a set of waveshape points which has an odd symmetry about the midpoint of the period. Alternatively a set of data points having an even symmetry could also be used in the system shown in FIG. 1 by eliminating the 2's complement 22.

One half of the points for the synthesized symmetric waveshape are stored in the first segment of the waveshape memory 25.

The preceding analysis steps are repeated for consecutive set of the original recorded data points until the end of the recorded tone is reached.

The use of a Fourier series waveshape synthesis to produce symmetrical waveshapes is disclosed in U.S. Pat. No. 3,763,364 entitled "Apparatus For Storing And Reading Out Periodic Waveforms." This patent is hereby incorporated by reference.

Figure 2:
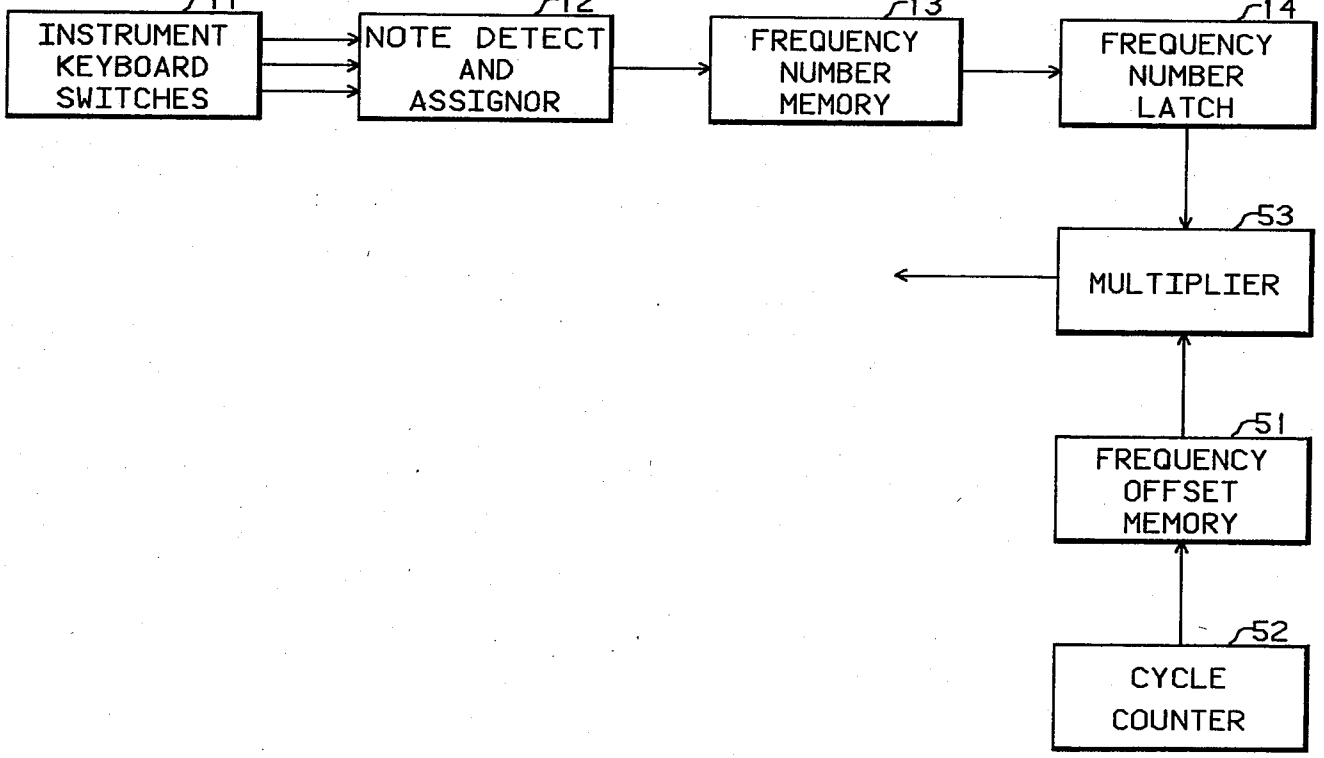
FIG. 2 is a schematic diagram of an alternate embodiment of the invention.

FIG. 2 illustrates an alternative embodiment of the present invention. To provide an economy in the size of the waveshape memory 25, a single waveshape memory can be used for several contiguous musical notes rather than to provide an individual and distinct memory for each musical note. In the system shown in FIG. 2, the multiplier 53 is used to replace the adder 50 which is used in the system configuration shown in FIG. 1. A different type of data is now stored in the frequency offset memory 51.

Instead of using an offset frequency number, a scale factor is now used which provides a constant cent offset for the fundamental frequency. The cent offset is independent of a particular value of the fundamental frequency.

A musical cent C is defined by the expression $$C = k \log f_1/f_0 \quad \text{Eq. 9}$$

where the log is a natural logarithm and $$k = 1200/\log 2 \quad \text{Eq. 10}$$

Eq. 9 can be written as $$f_1 = f_0 \exp (C/K) \quad \text{Eq. 11}$$

where $f_0$ is the true averaged fundamental frequency and $f_1$ is the desired frequency. Thus $$f_1 = f_0 + f \quad \text{Eq. 12}$$

Combine Eq. 11 and 12 to obtain $$f = f_0[\exp (C/K) - 1] \quad \text{Eq. 13}$$

The corresponding change in the frequency number is $$R = R[\exp (CK) - 1] \quad \text{Eq. 14}$$

The values in the square bracket of Eq. 14 are the values that are stored in the frequency offset memory 51.

Figure 3:
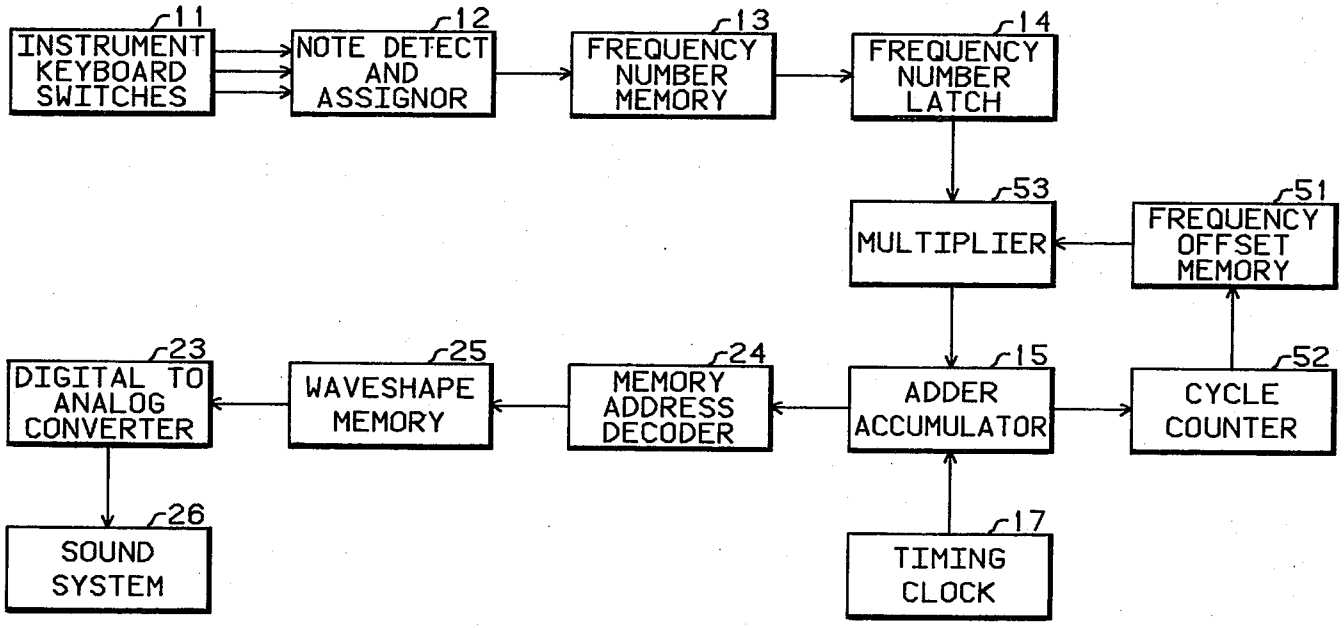
FIG. 3 is a schematic diagram of the invention incorporated into a "Digital Organ."

The present invention can be applied advantageously to other types of musical tone generators. One such musical tone generator is described in U.S. Pat. No. 3,515,792 entitled "Digital Organ." This patent is hereby incorporated by reference. FIG. 3 illustrates a system configuration for combining the present invention with the tone generator described in the referenced U.S. Pat. No. 3,515,792.

The tone generator shown in FIG. 3 differs from those shown in FIG. 1 and FIG. 2 in that the waveshape memory 25 only stores a single period of a musical waveshape.

When the note detect and assignor 12 finds that a keyboard switch, contained in the system block labeled instrument keyboard switches 11, has a switch status change to an actuated switch state, a frequency number corresponding to the actuated keyswitch is read from the frequency number memory 13 in response to the encoded detection information stored in the note detect and assignor 12. The frequency number read out of the frequency number memory 13 is stored in the frequency number latch 14.

In response to the count state of the cycle counter 52, an offset number corresponding to the square bracket in Eq. 14 is read out of the frequency offset memory 51. The accessed offset number is multiplied by the frequency number contained in the frequency number latch by means of the multiplier 53 to produce a scaled frequency number.

In response to timing signals produced by the timing clock 17, the scaled frequency number produced by the multiplier 53 is successively added to the content of an accumulator contained in the adder-accumulator 15. The content of this accumulator is the accumulated sum of a frequency number.

The integer portion of the accumulated frequency number in the adder-accumulator 15 is used by the memory address decoder 24 to read out waveshape data values stored in the waveshape memory 25. Each time that the seventh bit to the left of the radix point of the accumulated frequency number changes its state, a count signal is generated by the adder accumulator. The count signal is used to increment the count state of the cycle counter 52.

The data values read out of the waveshape memory 25 are transformed into an analog signal by the digital-to-analog converter 23. The resultant analog signal is converted into an audible musical tone by the sound system 26.

Figure 4:
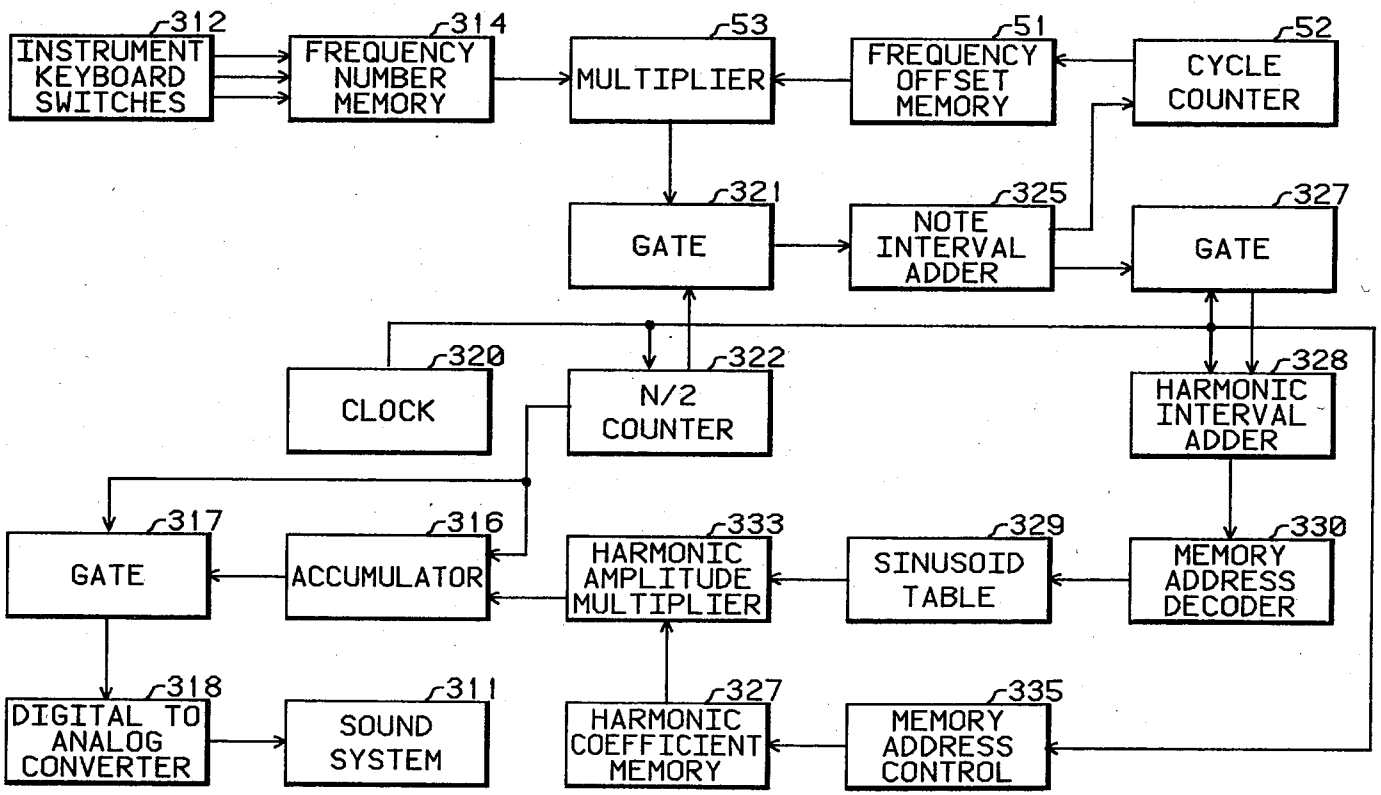
FIG. 4 is a schematic diagram of the invention incorporated into a "Computor Organ."

FIG. 4 illustrates a musical tone generation system combining the present invention with the musical tone generation system described in U.S. Pat. No. 3,809,786 entitled "Computor Organ." This patent is hereby incorporated by reference.

A closure, or actuation, of a keyswitch contained in the system block labeled instrument keyboard switches 312 causes a corresponding frequency number to be read out from the frequency number memory 314.

The system blocks in FIG. 4 having a number in the 300 range correspond to 300 added to the system block numbers shown in FIG. 1 of the referenced U.S. Pat. No. 3,809,786.

In response to the count state of the cycle counter, an offset number corresponding to the square bracket in Eq. 14 is read out of the frequency offset memory 51. The accessed offset number is multiplied by the frequency number read out from the frequency number memory 314 by means of the multiplier 53 and the scaled frequency number is transferred to the gate 321.

The remainder of the system elements shown in FIG. 4 operate in the manner described in the referenced U.S. Pat. No. 3,809,786. The note interval adder successively adds the scaled frequency number transferred by the gate 321 to an accumulator to produce an accumulated frequency number. Each time that the seventh bit to the left of the radix point of the accumulated frequency number changes its state, a count signal is generated which is used to increment the count state of the cycle counter 52.

The accumulated frequency contained in the note interval adder specifies the sample point at which a waveshape amplitude is calculated. For each sample point, the amplitudes of a number of harmonic components are calculated by individually multiplying harmonic coefficients read out of the harmonic coefficient memory 327 by trigonometric sinusoid values read out of the sinusoid table 329. The harmonic component amplitudes produced by the harmonic amplitude multiplier 333 are summed algebraically in the accumulator 316 to obtain the net amplitude at a waveshape sample point. The sample point amplitudes are converted into an analog signal by means of the digital-to-analog converter 318 and the analog signal is furnished to the sound system 3111.

The harmonic interval counter 328 is initialized by a signal provided by the N/2 counter 322. In response to timing signals generated by the clock 320, the harmonic interval adder 328 successively adds the content of the note interval adder to the content of an accumulator contained in the harmonic interval adder 328. The memory address decoder 330 reads out a trigonometric sinusoid function value from the sinusoid table 329 in response to the content of the accumulator in the harmonic interval adder 328.

In response to timing signals produced by the clock 320, the memory address control 335 reads out harmonic coefficient values stored in the harmonic coefficient memory 327.

I claim:

1. In combination with a keyboard operated musical instrument having an array of keyswitches, apparatus for producing a musical tone having temporal variations of a fundamental frequency comprising;

an assignor means whereby a detect data word is generated in response to each actuated keyswitch in said array of keyswitches and whereby one of a plurality of tone generators is assigned to each actuated keyswitch and whereby a corresponding detect data word is provided to the corresponding said assigned tone generator; and said plurality of tone generators each of which comprises, a waveshape memory means for storing a plurality of data words stored in contiguous segments of data words, a frequency number generator means wherein a frequency number is generated corresponding to said provided defect data word, a frequency number scaling means wherein each said generated frequency number is varied in magnitude in response to a time variant scale signal to produce a scaled frequency number, a scaling generator means for generating said time variant scale signal, a memory addressing means responsive to said provided detect data word whereby a selected segment of data words is read out from one of said waveshape waveshape memory means at a memory advance rate responsive to said scaled frequency number and whereby said selected segment of data words is read for a preselected number of timing periods during each of which the stored data words in said segment of data words is read out in a first order followed by reading out the same segment of data words in reverse order, and a conversion means for producing a musical tone responsive to data words read out from said waveshape memory means.

2. In a musical instrument according to claim 1 wherein said assignor means comprises assignor circuitry whereby said scaled frequency number is transferred to one of said plurality of tone generators assigned to a corresponding detect data word.

3. A musical instrument according to claim 2 wherein said memory addressing means comprises;

a timing clock for providing timing signals, an adder-accumulator means, comprising an accumulator responsive to said timing signals for successively adding said scaled frequency number to the contents of said accumulator to produce an accumulated frequency number, and a reading means responsive to said scaled frequency number and responsive to said accumulated frequency number whereby a selected segment of data words is read out from said waveshape memory means corresponding to said assigned tone generator for a preselected number of timing periods.

4. In a musical instrument according to claim 1 wherein said assignor means comprises;

a keyswitch state detect means wherein a detect signal is generated in response to each actuated keyswitch in said array of keyswitches, and an encoding means for encoding each said detect signal to generate said corresponding data detect word which identifies each said actuated keyswitch corresponding to a generated detect signal.

5. In a musical instrument according to claim 1 wherein said waveshape memory means stores a plurality of segments of data words and wherein each said segment of data words corresponds to one half of the period of a waveshape having a symmetry about a midpoint having the number of data words as that in said segment of data words.

6. In a musical instrument according to claim 1 wherein said conversion means for producing a musical tone comprises;

a signal conversion means for converting data words read out from said waveshape memory means to produce said musical tone having temporal variations of a fundamental frequency.

7. In a musical instrument according to claim 1 wherein said frequency number scaling means comprises;

an adder means whereby said frequency number is added to said time variant scale signal to produce said scaled frequency number.

8. In a musical instrument according to claim 1 wherein said frequency number scaling means comprises;

a multiplier means wherein said frequency number is multiplied by said time variant scale signal to produce said scaled frequency number.

9. In combination with a keyboard operated musical instrument having an array of keyswitches, apparatus for producing musical tones having temporal variations of a fundamental frequency comprising;

an assignor means whereby a detect data word is generated in response to each actuated keyswitch in said array of keyswitches and whereby one of a plurality of tone generators is assigned to each actuated keyswitch and whereby a corresponding detect data word is provided to the corresponding said assigned tone generator; and said plurality of tone generators each of which comprises, a waveshape memory means for storing a plurality of data words stored in contiguous segments of data words, a frequency number generator means wherein a frequency number is generated corresponding to said provided detect data word, a frequency number scaling means wherein each said generated frequency number is varied in magnitude in response to a time variant scale signal to produce a scaled frequency number, a scaling generator means for generating said time variant scale signal, a timing clock for providing timing signals, an adder-accumulator means, comprising an accumulator, responsive to said timing signals for successively adding said scaled frequency number to the contents of said accumulator to produce an accumulated frequency number, a first state detect means whereby a first state change signal is generated in response to a binary state change in a preselected bit position of said accumulated frequency number, a gate means interposed between said timing clock and said adder-accumulator means whereby in response to said first state change signal said timing signals are not transferred to said adder-accumulator means and whereby in response to a second state change signal said timing signals are transferred to said adder-accumulator means, a number memory means for storing said accumulated frequency number in response to said first state change signal, a subtract means responsive to said timing signals whereby said generated frequency number is successively subtracted from the accumulated frequency number contained in said number means to produce a modified accumulated frequency number, a second state detect means whereby said second state change signal is generated in response to a binary state change in said preselected bit position of said modified accumulated frequency number, a data select means whereby in response to said second state change signal said accumulated frequency number contained in said adder-accumulator is selected and whereby in response to said first state change signal said modified accumulated frequency number in said number means is selected, a waveshape memory reading means for reading out data words from said waveshape memory means in response to the output from said data select means, and a conversion means for producing a musical tone responsive to data words read out from said waveshape memory means.

10. In a musical instrument according to claim 9 wherein said waveshape memory means stores a plurality of segments of data words and wherein each segment of data words corresponds to one half of the period of a waveshape having an odd symmetry about a midpoint having the number of data words as that in said segment of data words.

11. In a musical instrument according to claim 10 wherein said conversion means for producing a musical tone comprises;

a complementing means whereby a 2's complement binary operation is performed on the data words read out of said waveshape memory means in response to said first state change signal, and a signal conversion means for converting the data words read out from said waveshape memory means to produce said musical tone.

12. In a musical instrument according to claim 9 wherein said scaling generator means comprises;

a scale memory for storing a set of time variant scale signals, a cycle counter incremented in response to said first state change signal, and a second memory addressing means for reading out a time variant scale signal in response to the count state of said cycle counter.

13. In combination with a musical instrument having an array of keyswitches, apparatus for producing a musical tone having temporal variations of a fundamental frequency comprising;

a frequency number generator means wherein a frequency number is generated corresponding to an actuated switch in said array of keyswitches, an assignor means for assigning one of a plurality of tone generators to an actuated keyswitch in said array of keyswitches and whereby said generated frequency number is provided to an associated assigned tone generator; and said plurality of tone generators each of which comprises, a waveshape memory for storing a set of data words corresponding to musical waveshape, a frequency number scaling means wherein said frequency number provided to said associated assigned tone generator is varied in magnitude in response to a time variant scale signal to produce a scaled frequency number, a scaling generating means for generating said time variant scale signal, a memory addressing means whereby said set of data words are read out of said waveshape memory at a memory advance rate responsive to said scaled frequency number, a conversion means for producing a musical tone responsive to data words read out from said waveshape memory.

14. In combination with a musical instrument having an array of keyswitches, apparatus for producing a musical tone having temporal variations of a fundamental frequency comprising;

a coefficient memory means for storing a set of harmonic coefficient values, a frequency number generator means wherein a frequency number is generated corresponding to an actuated keyswitch in said array of keyswitches, a frequency number scaling means wherein said frequency number is varied in magnitude in response to a time variant scale signal to produce a scaled frequency number, a scaling generating means for generating said time variant scale signal, a computing means responsive to said set of harmonic coefficient values and said scaled frequency number for computing a sequence of data words at a regular time intervals, and a means for producing musical waveshapes from said sequence of data words thereby producing said musical tone having temporal variations of a fundamental frequency.

15. In a musical instrument according to claim 14 wherein said computing means comprises;

a note interval adder wherein said scaled frequency number is successively added to the sum previously contained in said note interval adder, a harmonic interval adder cleared before each computation of one of said sequence of data words wherein the content of said note interval adder is added to the contents previously in said harmonic interval adder, a sinusoid table for storing a plurality of trigonometric sinusoid values, an address decoder means responsive to the contents of said harmonic interval adder for reading out trigonometric sinusoid values from said sinusoid table, a multiplying means for multiplying the trigonometric sinusoid values read out from sinusoid table by harmonic coefficient values read out from said coefficient memory means, and a means for successively summing the output from said multiplying means thereby producing each one of said sequence of data words.

* * * * *